US006722902B2

(12) United States Patent
Kedzierski

(10) Patent No.: US 6,722,902 B2
(45) Date of Patent: Apr. 20, 2004

(54) SOLDER-LESS, CRIMP-LESS ELECTRICAL CONNECTOR

(76) Inventor: John Kedzierski, 14 Hamilton St., Bloomingdale, NJ (US) 07403

( * ) Notice: Subject to any disclaimer, the term of this patent is extended or adjusted under 35 U.S.C. 154(b) by 0 days.

(21) Appl. No.: 10/155,551

(22) Filed: May 25, 2002

(65) Prior Publication Data

US 2003/0220005 A1 Nov. 27, 2003

(51) Int. Cl.[7] ..... H01R 29/00
(52) U.S. Cl. ..... 439/173; 439/172; 439/598
(58) Field of Search ..... 439/173, 866, 439/598, 685, 172

(56) References Cited

U.S. PATENT DOCUMENTS

| | | | | | |
|---|---|---|---|---|---|
| 4,145,566 | A | | 3/1979 | Weingartner | 174/65 R |
| 4,310,213 | A | * | 1/1982 | Fetterolf, Sr. et al. | 439/320 |
| 4,385,791 | A | * | 5/1983 | Lovrenich | 439/83 |
| 4,392,699 | A | | 7/1983 | Weingartner | 439/686 |
| 4,585,286 | A | | 4/1986 | Parr | 439/173 |
| 4,647,127 | A | | 3/1987 | Weingartner | 439/289 |
| 4,657,327 | A | | 4/1987 | Weingartner | 439/289 |
| 4,787,862 | A | | 11/1988 | Lee | 439/502 |
| 5,083,935 | A | | 1/1992 | Herman | 439/433 |
| 5,232,378 | A | | 8/1993 | Weingartner | 439/354 |
| 5,244,419 | A | | 9/1993 | Ju | 439/686 |
| 5,362,258 | A | * | 11/1994 | Arnswald et al. | 439/695 |
| 5,395,264 | A | | 3/1995 | Keith | 439/502 |
| 5,403,201 | A | | 4/1995 | McCarthy | 439/427 |
| 5,632,655 | A | * | 5/1997 | DeMarco, Jr. | 439/655 |
| 5,704,799 | A | * | 1/1998 | Wood | 439/281 |
| 5,791,919 | A | | 8/1998 | Brisson et al. | 439/166 |
| 5,792,986 | A | * | 8/1998 | Lee | 174/72 A |
| 5,847,320 | A | | 12/1998 | Fisher | 174/87 |
| 5,890,925 | A | | 4/1999 | Bernardini | 439/433 |
| 5,975,948 | A | | 11/1999 | Weaver | 439/578 |
| 5,984,703 | A | | 11/1999 | Weingartner | 439/181 |
| 6,056,599 | A | * | 5/2000 | Flickinger et al. | 439/598 |
| 6,116,945 | A | * | 9/2000 | Davis et al. | 439/462 |
| 6,146,168 | A | | 11/2000 | Ishii | 439/188 |
| 6,261,124 | B1 | | 7/2001 | Brock | 439/540.1 |
| 6,341,979 | B1 | | 1/2002 | Yamamoto | 439/415 |

* cited by examiner

*Primary Examiner*—Michael C. Zarroli
(74) *Attorney, Agent, or Firm*—Jennifer Meredith; Meredith & Keyhani, PLLC

(57) ABSTRACT

An apparatus for connecting electrical wires comprising a connector block having three wells, wherein each well receives an electrically conducting wire, and three pins, each having two ends wherein the first end of each pin is removably contained its own well and the second end of each pin is in electrical contact with a pin of an XLR connector. The connector further comprises a plate for removably securing these pins and a body encasing the connector block and the first end of each pin, wherein the connector strip is a terminal strip and allows for the receipt of a second set of electrically conducting wires in contact with each pin and provides an electrical connection to a second audio component so as to effectuate a daisy chain between a multitude of audio components.

25 Claims, 7 Drawing Sheets

SOLDER-LESS, CRIMP-LESS ELECTRICAL CONNECTOR

BACKGROUND OF THE INVENTION

The present invention generally relates to electrical connection apparatus and more particularly to an electrical plug or connector assembly wherein there is no need for crimping or soldering.

Electrical connectors of various types have been disclosed in the prior art, and various adapters have been employed in attempts to mate mismatched electrical connectors. U.S. Pat. No. 4,585,286 issued to Parr discloses a Universal Electrical Plug Adapter to convert a three-prong male household plug to a three-prong male OSHA twistlock connector and vice versa. Electrical plug connector assemblies are generally utilized for the purpose of transmitting electrical currents or signals without loss and without interference. Such apparatus must function in a manner as though line transmission therethrough was not interrupted at all at the location of the connector.

Electrical connectors may also be used to connect two audio components to transfer an audio signal between the components. U.S. Pat. No. 4,787,862 issued to Lee discloses an apparatus for electrically connecting two audio components for transferring an audio signal between the components. The '862 describes an apparatus for improved audio signals by separating a two conductor wire to two individual connectors such as to improve the quality.

The connection of audio wires is known within the art, as are various connectors. However, professional audio systems generally use balanced lines. In contrast to unbalanced systems, which generally use a single conductor plus a combined negative and shield between the signal source and amplifier, balanced systems use two conductors plus a shield. One conductor carries the main signal, while the other conductor carries the inverse of the signal (180 degrees out of phase). The two together are referred to as a "differential" signal. As this differential signal is passed through the wires, they pick up the same noise as the unbalanced signal does. Both the negative and positive signals have the same noise added to them by the time they reach the amplifier. In a balanced system, when the signals "A" and "−A" are processed by the amplifier, the output is equal to A−(−A) which equals 2A. This means that the signal has doubled and the noise has been cancelled to zero. Because of this balanced lines are desirable and accomplish the goal of removing common-mode noise.

It is desirable to connect cables and wires using balanced connectors. There are a number of different types of connectors known within the art including RCA, XLR, Toslonk (fiber optic) and AT&T ST (glass fiber-optic). RCA connectors are standard, low-level signal interconnect termination or connectors featuring a single, cylindrical metal rod and an outer, round metal belt. Also known within the art are XLR connectors. The XLR connector derived from a series of connectors, each an improvement on the prior connect. First, was the Cannon "X series" connector. The "X series" connector fit the demands of the audio community except that it wouldn't latch into place, and came unplugged easily. Cannon rearranged the pins and added a latch to create the Cannon "XL Series". Later, the female version was changed to put the contacts in a resilient runner compound, as so became the "XLR Series" which became the industry standard in 1982 according to the Audio Engineering Society (AES). U.S. Pat. No. 4,392,699, which is incorporated by reference, depicts a typical XLR connector. RadioShack™ also sells XLR connectors, and a good example is model 274-011. This is a 3-Pin XLR inline jack. XLR connectors are manufactured by a number of companies including ITT Cannon™, Switchcraft™, Neutrik™ and others. Many cables utilize XLR connectors, and usually have a female and a male end. This is useful in that a number of cables can be strung together to achieve any desired length. XLR connectors are also desirable in that they provide balanced lines which are capable of traveling greater distances without destructive interferences.

While XLR connectors provide professional audio connections, they are fraught with problems in connecting with other audio components. Specifically, attaching wires to the XLR connector and a component is extremely time consuming, requires other equipment for soldering or crimping, it is difficult to achieve desired results. Also, it leaves a semi-permanent connection to the connector. That is, it must be heated to remove the solder and re-soldered to reattach.

The process of connecting an XLR connector to another audio component is an arduous task. In order to connect an XLR connector to another component you must disassemble the XLR connector. This is accomplished by removing the cable jacket, striping the three wires of the cable, placing the stripped cable into a vice and soldering the wires. This must be done cautiously as to avoid wicking (where solder travels up the wire and under the insulating jacket, causing hidden faults in the cable that are hard to locate). Then the XLR connector is placed in the vice and solder allowed to flow into the solder cups. Next the pin number designations on the connector must be identified. Typically XLR connectors follow the Audio Engineering Society (AES) and the Electronic Industries Alliance (EIA) standards which states the pin #1 is ground, pin #2 is high (+) and pin #3 is low (−). Upon identifying pin #1, the shield is connected to this pin by reheating the solder cup and inserting the pretinned conductor. Next pin #2 is soldered, by reheating the solder cup and inserting the pretinned conductor. And finally, pin #3 is soldered by reheating the solder cup and inserting the pretinned conductor. Then heat shrink is placed over the area where the original cable jacket was. This process is complex, requiring time and special equipment. Also, it creates a number of problems such as cold or incomplete solder joints, and difficult removal of a faulty cable, which further adds to the time it takes to install equipment. Also, this creates additional points where problems can occur that are difficult to diagnose.

As can be seen there is a need for an apparatus for connecting electrically conducting wires that is easily installed, easily replaced, does not require soldering or crimping, and provides easy connection combined with improved overall performance realized by a solid connection.

SUMMARY OF THE INVENTION

The present invention is directed to connectors for electrical components, and in particular audio components. The apparatus may be used to electrically connect an audio component with an XLR connector without the need for soldering or crimping.

One aspect of the invention is an apparatus for connecting electrical wires comprising a connector block, wherein the connector block has a first well, a second well and a third well in the connector block. The first well, second well and third well each receives an electrically conducting wire in the respective well. A first pin with a first end and a second end, a second pin with a first end and a second end, and a third pin with a first end and a second end and removably contained within the wells. The first end of the first pin is removably contained within the first well, the second end of the first pin is in electrical contact with a pin of an XLR connector. The first end of the second pin is removably contained within the second well, the second end of the second pin is in electrical contact with a pin of an XLR connector. The first end of the third pin is removably contained within the third well and the second end of the third pin is in electrical contact with a pin of an XLR connector. A plate for removably securing the pins is at least partially encased by a body also encasing the connector block, the first end of first pin, the first end of second pin, and the first end of third pin. It should be understood that the assembly may be a single completed manufactured unit with no need for assembly or disassembly in the field. The installer inserts the unit into the xlr connector that is mounted in the audio device, and inserts the wires into the present invention.

According to another aspect of the present invention, an apparatus for connecting audio component electrical wires to an XLR connector is disclosed comprising a connector block with a top side and a bottom side. The connector block has a first well, a second well and a third well longitudinally extending through the connector block. The first well, second well and third well each receives an electrically conducting wire in the respective well along the top side. There may also be a first pin with a first end and a second end, a second pin with a first end and a second end, and a third pin with a first end and a second end. The first end of the first pin may be removably contained within a first well along the bottom side. The second end of the first pin may be in electrical contact with a first pin of an XLR connector. The first end of the second pin may be removably contained within the bottom side of the second well, the second end of the second pin may be in electrical contact with a second pin of an XLR connector. The first end of the third pin may be removably contained within the third well along the bottom side and the second end of the third pin may be in electrical contact with a third pin of an XLR connector. There may also be a plate for removably securing the pins within a body encasing at least a portion of the connector block, the first pin, the second pin, the third pin and the plate. The body may also provide a removably secured attachment to the XLR connector.

According to a further aspect of the present invention, an apparatus for connecting two audio components to transfer an audio signal between the components is disclosed. This apparatus may comprise three wells longitudinally extending through a connector block with a top side and a bottom side. The top side may be in communication with a terminal block so as to effectuate a solid connection between the wires and the pins. There may also be securing means, such as screws to effectuate a solid connection between the wires, the connector block and the pins. It may also be desirable to utilize a terminal block to create a daisy chain between a multitude of components. There may be three pins, wherein the bottom side of the connector block allows for the receipt of the three pins, the three pins each have a top end and a bottom end. The top end may be in electrical communication with corresponding electrically conducting wires. The bottom end of the three pins may be in electrical communication with an XLR connector and there may be a mechanical connecting means such as to effectuate a mechanical and electrical connection between said bottom end of three pins and said XLR connector.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense but is made merely for the purpose of illustrating the general principles of the invention.

The present invention provides a connector for electrical components that allows for the easy connection of wires to an XLR connector. It should be understood that these wires may be cables, and such cables come according to a variety of specifications including spiral, braided, gold and nickel contacts, reinforced cores, 1-40 gauge wire and many other types. The present invention is intended to allow for an apparatus that is capable of being used with any type of wire or cable such as to effectuate a connection between the wire and a connector.

Figure 1:
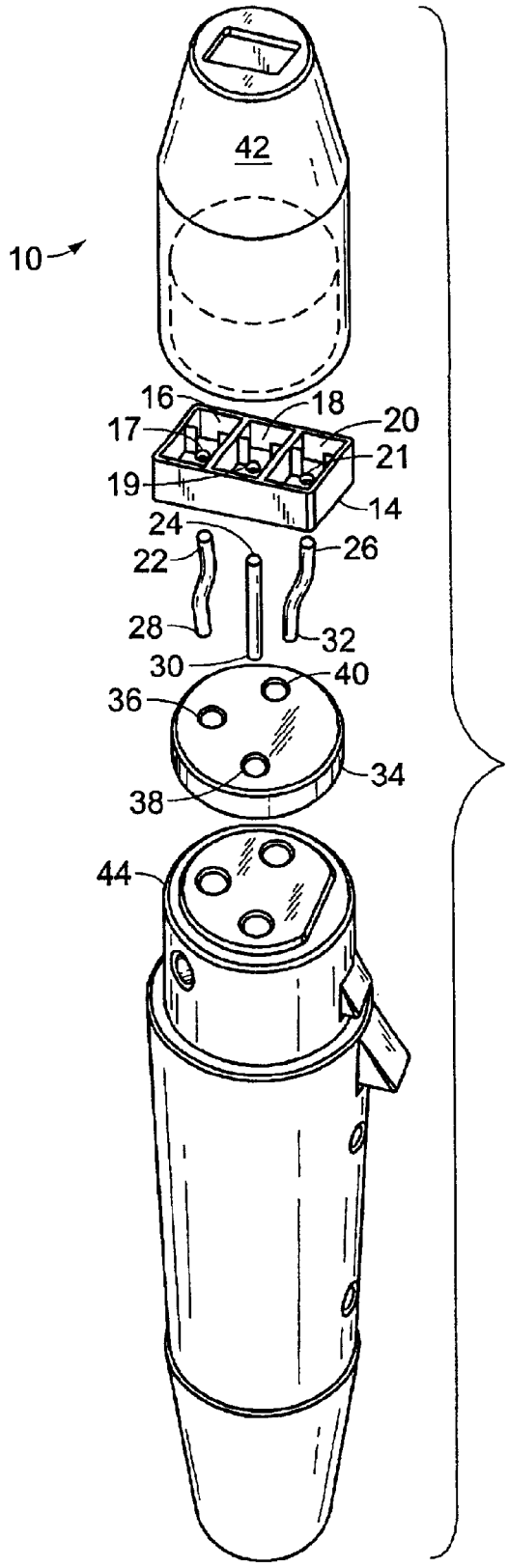
FIG. 1 is an exploded view of the present invention according to a preferred embodiment.

FIG. 1 depicts a preferred embodiment of the present invention. As shown the apparatus 10 is comprised of a connector block with a top side (shown) and a bottom side (not shown). There are three wells or recesses 16, 18, and 20. The bottom side receives a first pin, a second pin and a third pin in a corresponding well 16, 18 and 20. By way of example, the first end of first pin 22 may be placed in the bottom side of well 16, the first end of second pin 24 may be placed in the bottom side of well 18 and the first end of pin 26 may be placed in the bottom side of well 20. The second end of first pin 28 may then be placed in the first hole 36 of the plate 34 such that the second end of first pin 28 protrudes a significant distance from the plate 34, the second end of the second pin 30 may then be placed in the second hole 38 of the plate 34 such that the second end of the second pin 30 protrudes a significant distance from the plate 34, and the second end of the third pin 32 may be placed in the third hole 40 of the plate 34 such that the second end of third pin 28 protrudes a significant distance from the plate 34. The plate, as shown in FIG. 1 is a guiding plate. That is to say that the purpose of the plate is to guide pins such as to effectuate an electrical connection. The second end of the first pin 28, the second end of the second pin 30 and the second end of the third pin 32 may then be placed in a female XLR connector. The entire configuration, may then be encased in a body 42. A first wire, a second wire and a third wire may be placed in into the wells 16, 18, and 20 of top side 12 of the connector block so as to effectuate an electrical connection between three wires and respectively the first end of the first pin 22, the first end of the second pin 24 and the first end of the third pin 26. The wire may be carrying a signal level input between −60 db and +12 db between audio components. This creates an easy method of connecting wires to a female XLR connector 44.

Figure 2:
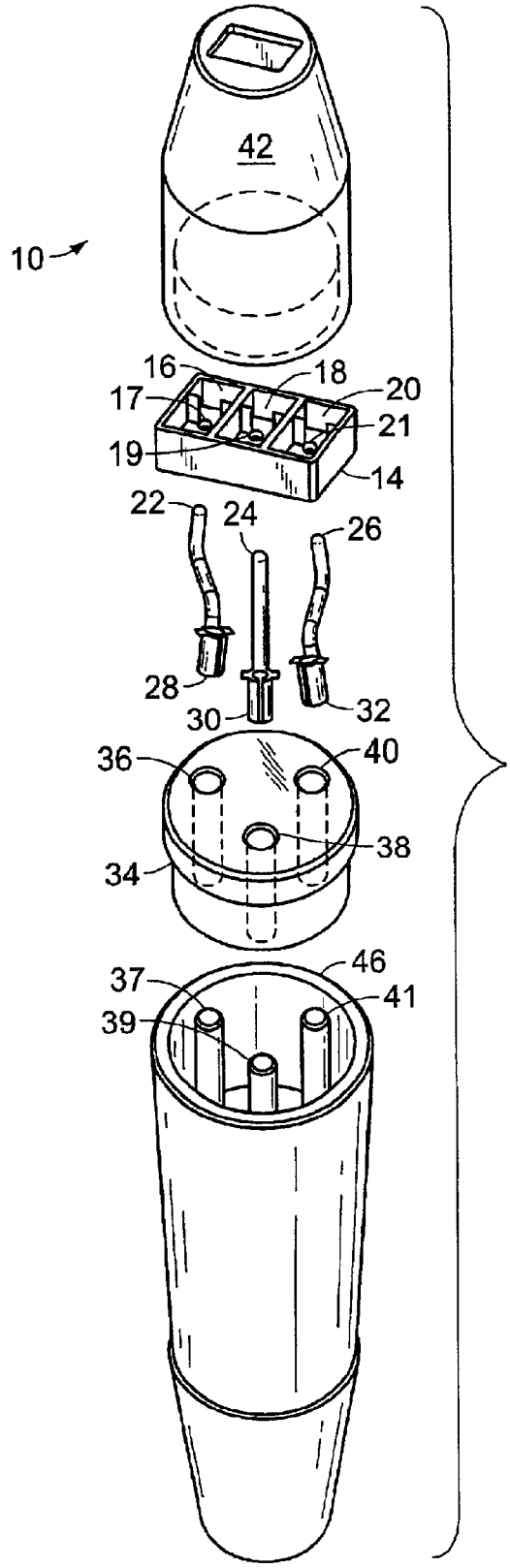
FIG. 2 is an exploded view of the present invention according to a preferred embodiment.

FIG. 2 depicts a preferred embodiment of the present invention. As shown the apparatus 10 is comprised of a connector block with a top side 12 and a bottom side 14, comprising three wells 16, 18, and 20. The bottom side receives a first pin, a second pin and a third pin in a corresponding well 16, 18 and 20. By way of example, the first end of first pin 22 may be placed in the bottom side of well 16, the first end of second pin 24 may be placed in the bottom side of well 18 and the first end of pin 26 may be placed in the bottom side of well 20. The second end of first pin 28 may then be placed in the first hole 36 of the plate 34 such that the second end of first pin 28 extends partially into the plate 34, the second end of the second pin 30 may then be placed in the second hole 38 of the plate 34 such that the second end of the second pin 30 extends partially into the plate 34, and the second end of the third pin 32 may be placed in the third hole 40 of the plate 34 such that the second end of third pin 28 extends partially into plate 34. The plate in this embodiment is a receiving plate, which is to say it acts to join pins within the plate. By way of example, the pin 37 of the XLR connector may meet up with the second end of first pin 28 within the receiving plate 34. In this way, the plate 34 receives both pins and allows an electrical connection to occur between the pins. The second end of second pin 30 may meet with a second pin 39 of the XLR connector, and the second end of third pin 32 may meet with a third pin 41 of the XLR connector. The entire configuration, may then be encased in a body 42. A first wire, a second wire and a third wire may be placed in the wells 16, 18, and 20 of top side of the connector block so as to effectuate an electrical connection between the first end of the first pin 22, the first end of the second pin 24 and the first end of the third pin 26 and the wires. The entire apparatus 10, may then be easily connected to a male XLR connector 46.

Figure 3A:
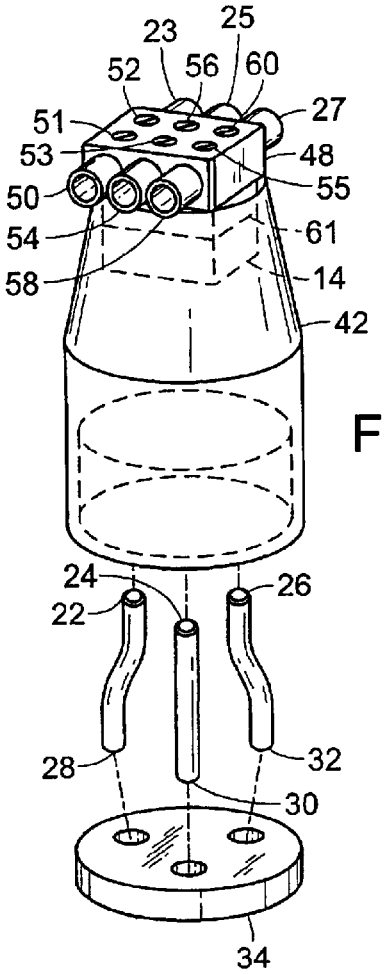
FIGS. 3A, 3B, 3C and 3D are exploded views of the present invention according to a preferred embodiment.
Figure 3B:
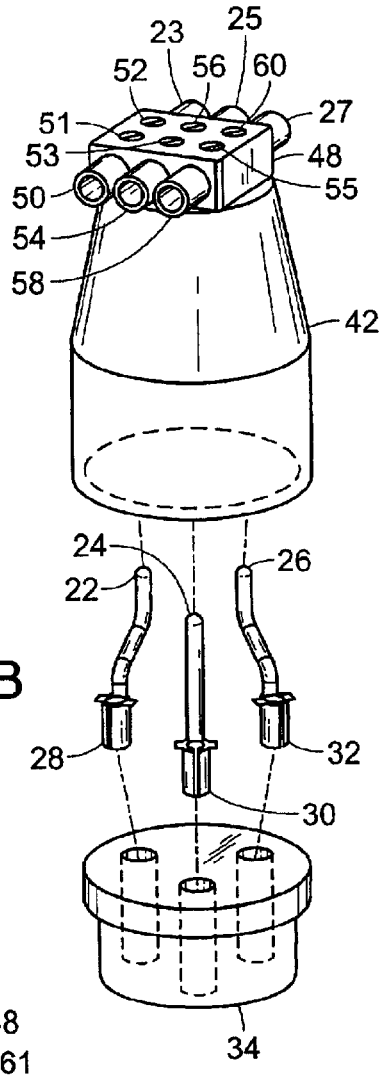
Figure 3C:
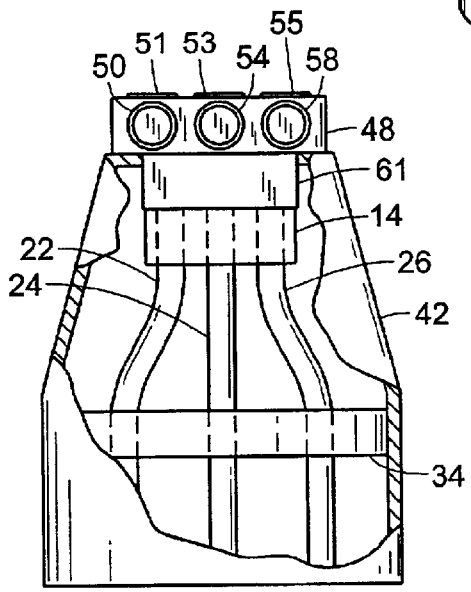
Figure 3D:
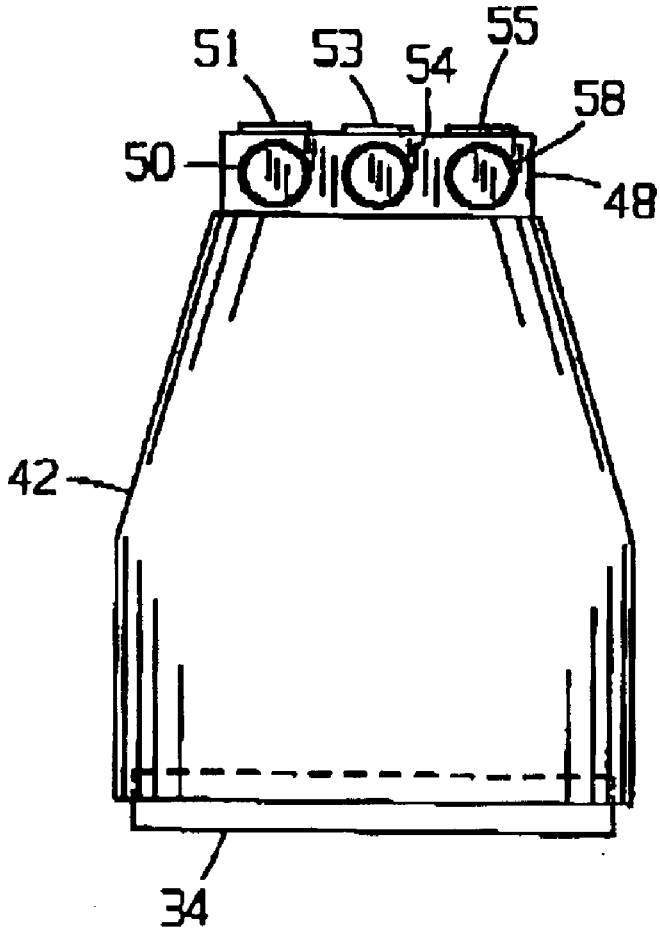

As shown in FIGS. 3A and 3B, a terminal strip 48 may be utilized to mechanically engage the wires and effectuate a sturdy connection between the wires, the connector block and the pins. As shown, a first wire may be placed in a first opening 50, then a first screw 51 tightened to secure the wire. A second wire may be placed in a second opening 54, and screw 53 tightened to secure the wire. A third wire may be placed in a third opening 58 and screw 55 tightened to secure the wire. The bottom portion 61 of terminal strip 48 is in connection with the wells of the connector block 14 which allow for the receipt of the wires and the first ends of pins 22, 24, 26 respectively, so as to effectuate a connection between the first ends of the pins and the respective wires. The present invention may also be used to provide for a "daisy-chain" between audio components. Daisy chaining is known within the art, to feed one electrical signal to a multitude of devices. The signal is fed into one device, back out and into another device. It is particularly well known to daisy chain devices in large sounds systems where there is one source, and more than one amplifier utilizing the same signal. The embodiments depicted in FIGS. 3A and 3B are particularly well suited for daisy chaining. In order to accomplish this, a first end of three wires would be inserted into the other side of openings 50, 54, and 58 which are 23, 25 and 27 respectively. The second end of these three wires may then be in electrical contact with a second audio component to effectuate an electrical connection between the first audio component and a second audio component. It should be understood that any number of apparatus according to the present invention may be utilized to effectuate a daisy chain between a multitude of audio components. In this way one signal may be fed to a multitude of devices.

Figure 4A:
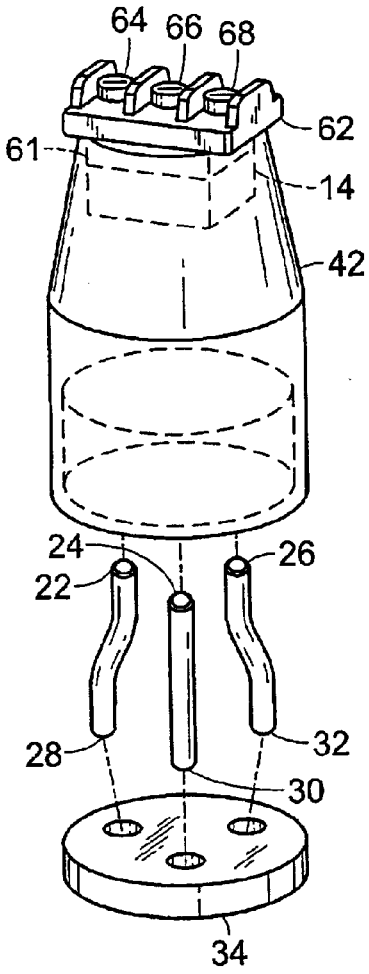
FIGS. 4A and 4B are exploded views of the present invention according to a preferred embodiment.
Figure 4B:
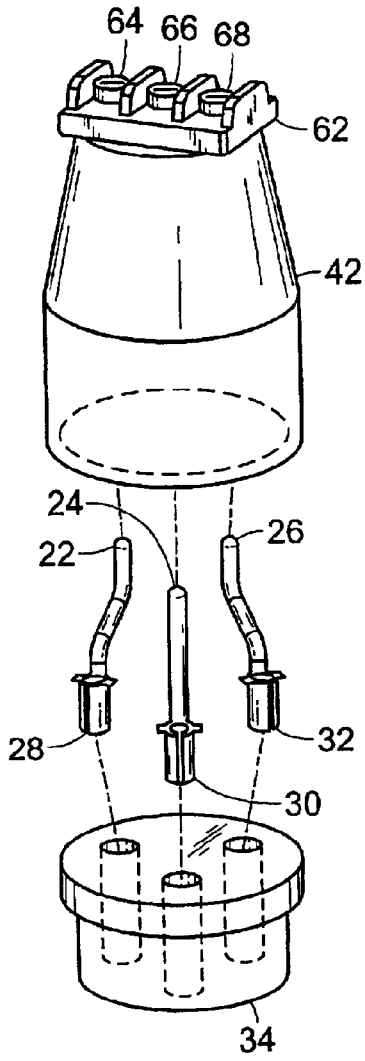

As shown In FIG. 4A and FIG. 4B, an open terminal strip 62 may be utilized to mechanically engage the wires and effectuate a sturdy connection between the wires and the pins. As shown, a first wire may be placed in under a first screw 64, which is then tightened to secure the wire. A second wire may be placed under a second screw 66, which is then tightened to secure the wire. A third wire may be placed under a third screw 68, the screw is then tightened to secure the wire. The bottom side 61 of the open terminal strip 62 is in connection with a connector block which has wells for the receipt of the first ends of pins 22, 24, 26 respectively, so as to effectuate an electrical connection between the first ends of the pins and the respective wires. The term quickly removably connected is used with intent to indicate a solderless connection which is quicker and easier to disconnect than a soldered connection which is also considered removable. It should be understood, as is known in the art, that the wires may be in electrical communication with the screws, which are in turn in electrical communication with the pins. Also, the wires may be in direct electrical communication with the pins.

Figure 5A:
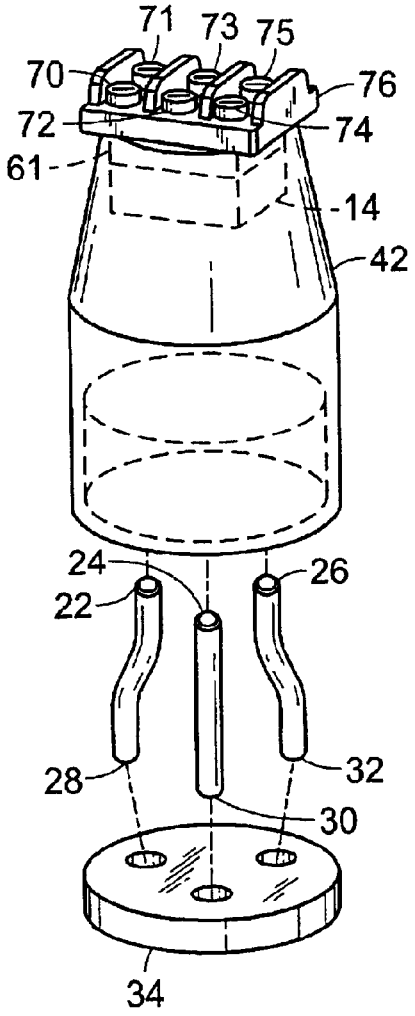
FIGS. 5A and 5B are exploded views of the present invention according to a preferred embodiment.
Figure 5B:
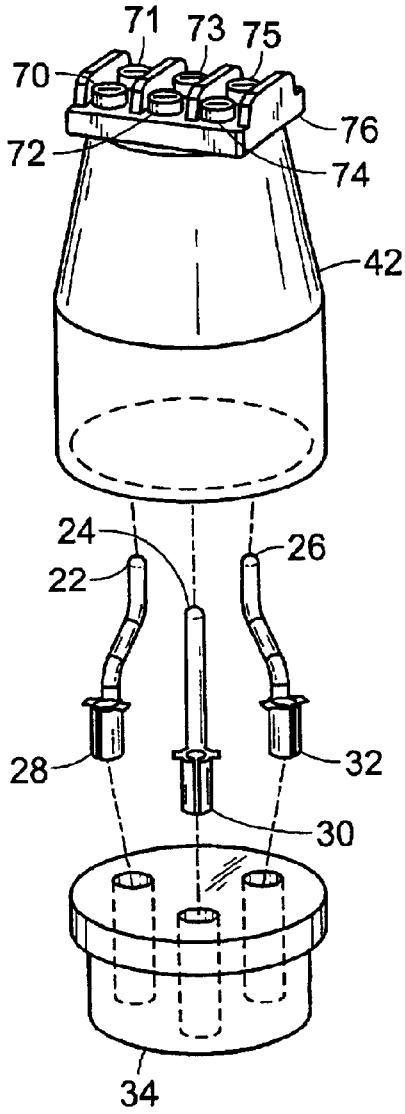

As shown in FIGS. 5A and 5B, a double open terminal strip 76 may also be utilized to mechanically engage the wires and effectuate a sturdy connection between the wires and the pins. The double open terminal strip 76 connector may also be used to daisy chain components. A first, second and third wire may be in electrical contact with an audio component. The first wire may be placed in under a first screw 70, which is then tightened to secure the wire. The second wire may be placed under a second screw 72, which is then tightened to secure the wire. The third wire may be placed under a third screw 74, the screw is then tightened to secure the wire. A fourth, fifth and sixth wire may each have one end attached to a second audio component. The other end of the fourth, fifth and sixth wire may then be attached to the second set of screws 71, 73, and 75 respectively. As such, a daisy chain is effectuated wherein the same signal is fed into a first receiving audio component, out of the first receiving audio component and into a second receiving audio component. As in the previous embodiments, the wire may then be in electrical communication with the pins, which is turn are in electrical communication with the XLR connector pins. Also, as in any of the embodiment the plate may be a guiding or receiving plate and the pins may be any number of different types of pins.

The bottom side 61 of the double open terminal strip is in communication with the connector block 14 to effectuate a connection between the first ends of the pins and the respective wires.

FIGS. 6–12 depicts pin variations. It should be understood that a number of different types of pins may be utilized. It should also be understood that each pin may be used in a male to male and/or male to female arrangement.

Figure 6:
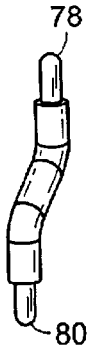
FIG. 6 is a side view of a pin of the present invention according to a preferred embodiment.

FIG. 6 depicts a solid metal pin with formed ends 78 and 80.

Figure 7:
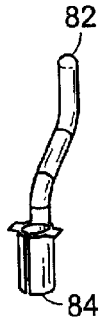
FIG. 7 is a side view of a pin of the present invention according to a preferred embodiment.

FIG. 7 depicts a pin with a solid metal pin end 82 and a flat metal formed end 84.

Figure 8:
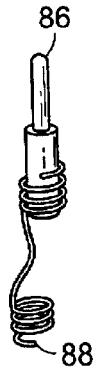
FIG. 8 is a side view of a pin of the present invention according to a preferred embodiment.

FIG. 8 depicts a formed metal pin end 86 and a wrapped wire end 88. In this arrangement the wire may be in contact with a pin of the XLR connector.

Figure 9:
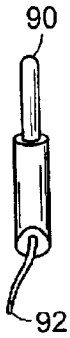
FIG. 9 is a side view of a pin of the present invention according to a preferred embodiment.

FIG. 9 depicts a solid metal pin end 90 and a depth stop collar and solder socket/cup end 92. FIGS. 6–12 are all methods of transferring the electrical signal from the male XLR connection to the phoenix connector or back side of the terminal connectors. It is the internal wiring of the units. The soldering would be done in the manufacturing of the devise and not in the field. The wire wrap may be square or any shape known within the art.

Figure 10:
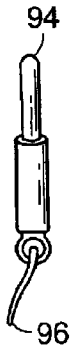
FIG. 10 is a side view of a pin of the present invention according to a preferred embodiment.

FIG. 10 depicts a solid metal pin end 94 and a depth stop collar and solder eyelet end 96.

Figure 11:
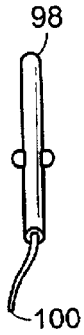
FIG. 11 is a side view of a pin of the present invention according to a preferred embodiment.

FIG. 11 depicts a solid metal pin end 98 and a depth stop ear and solder socket/cup end 100.

Figure 12:
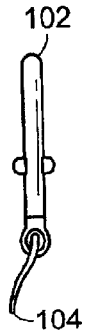
FIG. 12 is a side view of a pin of the present invention according to a preferred embodiment.

FIG. 12 depicts a solid metal pin end 102 and a depth stop ears and solder eyelet end 104. It should be understood that there may be a number of pin variations that are envisioned to effectuate an electrical connection.

It should be understood, of course, that the foregoing relates to preferred embodiments of the invention and that modifications may be made without departing from the spirit and scope of the invention as set forth in the following claims.

We claim:

1. An apparatus for connecting electrical wires comprising:

a connector block, wherein said connector block has a first well, a second well and a third well, wherein said first well, said second well and said third well each receives an electrically conducting wire in the respective well;

a first pin with a first end and a second end;

a second pin with a first end and a second end;

a third pin with a first end and a second end;

wherein said first end of said first pin is quickly removably contained within said first well, said second end of said first pin is in electrical contact with a pin of an XLR connector, said first end of said second pin is quickly removably contained within said second well, said second end of said second pin is in electrical contact with a pin of an XLR connector, said first end of said third pin is quickly removably contained within said third well and said second end of said third pin is in electrical contact with a pin of an XLR connector;

a plate for quickly removably securing said pins; and a body encasing said connector block, said first end of first pin, said first end of second pin, said first end of third pin and a portion of said plate.

2. An apparatus as in claim 1, wherein said connector block is selected from the group consisting of euroblok, phoenix, screw, sleeve, double ended phoenix connector, terminal strip, enclosed terminal strip, TERMI-BLOK® barrier strip, taper pin & block, tab & receptacle, punch down block, gell connector.

3. An apparatus as in claim 2, wherein said connector block is a terminal strip and receives said wires and guides said wires into said connector block.

4. An apparatus as in claim 1, wherein said XLR connector is a female XLR or a male XLR connector.

5. An apparatus as in claim 1, further comprising at least one securing means to secure said wire in said well.

6. An apparatus as in claim 1, wherein said plate is chosen from the group consisting of a guiding plate or a receiving plate.

7. An apparatus as in claim 1, wherein said electrically conducting wire is connected to an audio component selected from the group consisting of processors, auto mixers, reverb units, compressors, limiters, delays, routers, surround sound processors, amplifiers, digital to analog converters, analog to digital converters, speaker processors, connecting panels, microphone boxes, and microphone snakes.

8. An apparatus for connecting electrical wires comprising:

a connector block, wherein said connector block has a first well, a second well and a third well, wherein said first well, said second well and said third well each receives an electrically conducting wire in the respective well;

a first pin with a first end and a second end;

a second pin with a first end and a second end;

a third pin with a first end and a second end;

wherein said first end of said first pin is removably contained within said first well, said second end of said first pin is in electrical contact with a pin of an XLR connector, said first end of said second pin is removably contained within said second well, said second end of said second pin is in electrical contact with a pin of an XLR connector, said first end of said third pin is removably contained within said third well and said second end of said third pin is in electrical contact with a pin of an XLR connector;

a plate for removably securing said pins;

a body encasing said connector block, said first end of first pin, said first end of second pin, said first end of third pin and a portion of said plate, wherein said connector strip is a terminal strip and allows for the receipt of a second set of electrically conducting wires in contact with said first pin, said second pin and said third pin and provides an electrical connection to a second audio component so as to effectuate a daisy chain between a multitude of audio components.

9. An apparatus for connecting audio component electrical wires to an XLR connector comprising:

a connector block with a top side and a bottom side, wherein said connector block has a first well, a second well and a third well in said connector block, wherein said first well, said second well and said third well each receives an electrically conducting wire in the respective well along said top side;

a first pin with a first end and a second end;

a second pin with a first end and a second end;

a third pin with a first end and a second end;

wherein said first end of said first pin is quickly removably contained within said first well along said bottom side, said second end of said first pin is in electrical contact with a first pin of an XLR connector, said first end of said second pin is quickly removably contained within said bottom side of said second well, said second end of said second pin is in electrical contact with a second pin of an XLR connector, said first end of said third pin is quickly removably contained within said third well along said bottom side of said third well and said second end of said third pin is in electrical contact with a third pin of an XLR connector;

a plate for quickly removably securing said pins; and a body encasing at least a portion of said connector block, said first pin, said second pin, said third pin and said plate, wherein said connector block also provides for a quickly removably secured attachment to said XLR connector.

10. An apparatus as in claim 9, wherein said connector block is selected from the group consisting of euroblok, phoenix, screw, sleeve, double ended phoenix connector, TERMI-BLOK® barrier strip, taper pin & block, tab & receptacle terminal strip, terminal strip, enclosed terminal strip, punch down block, gell connector.

11. An apparatus as in claim 9, wherein said pins are made copper alloy, silver-plated copper alloy, tarnish-resistant copper-alloy or gold-plated copper alloy, brass, nickel, brass alloy, nickel alloys or any combinations thereof.

12. An apparatus as in claim 9, wherein said XLR connector is a female XLR or a male XLR connector.

13. An apparatus as in claim 9, further comprising at least one securing means to secure said wire in said well.

14. An apparatus as in claim 9, wherein said wherein said plate is chosen from the group consisting of a guiding plate or a receiving plate.

15. An apparatus as in claim 9, wherein said wire is connected to an audio component selected from the group consisting of processors, auto mixers, reverb units, compressors, limiters, delays, routers, surround sound processors, amplifiers, digital to analog converters, analog to digital converters, speaker processors, connecting panels, microphone boxes, and microphone snakes.

16. An apparatus for connecting electrical wires comprising:

a connector block, wherein said connector block has a first well, a second well and a third well, wherein said first well, said second well and said third well each receives an electrically conducting wire in the respective well;

a first pin with a first end and a second end;

a second pin with a first end and a second end;

a third pin with a first end and a second end;

wherein said first end of said first pin is removably contained within said first well, said second end of said first pin is in electrical contact with a pin of an XLR connector, said first end of said second pin is removably contained within said second well, said second end of said second pin is in electrical contact with a pin of an XLR connector, said first end of said third pin is removably contained within said third well and said second end of said third pin is in electrical contact with a pin of an XLR connector;

a plate for removably securing said pins:

a body for encasing at least a portion of said connector block, said first end of first pin, said first end of second pin, said first end of third pin and a portion of said plate, wherein said body also provides for a removably secured attachment to said XLR connector, wherein said connector strip is a terminal strip and allows for the receipt of a second set of electrically conducting wires in contact with said first pin, said second pin and said third pin and provides an electrical connection to a second audio component so as to effectuate a daisy chain between a multitude of audio components.

17. An apparatus for transferring an audio signal between at least two audio components, comprising;

a connector block with three wells and a top side and a bottom side;

a terminal block, wherein a bottom portion of said terminal block is in communication with the topside of said connector block;

a securing means to secure at least three electrically conducting wires within said terminal block;

three pins, wherein said bottom side of said connector block allows for the receipt of said three pins, said three pins each has a top end and a bottom end and said top end is in electrical communication with corresponding said electrically conducting wires, said bottom end of said three pins is in electrical communication with an XLR connector; and a mechanical connecting means such as to effectuate a mechanical and electrical connection between said bottom end of three pins and said XLR connector.

18. An apparatus as in claim 17, wherein said connector block is selected from the group consisting of euroblok, phoenix, screw, sleeve, double ended phoenix connector, TERMI-BLOK® barrier strip, taper pin & block, tab & receptacle terminal strip, enclosed terminal strip, punch down block, gell connector.

19. An apparatus as in claim 17, wherein a terminal strip is in connection with said connector so as to guide said wires.

20. An apparatus as in claim 17, wherein said pins are made copper alloy, silver-plated copper alloy, tarnish-resistant copper-alloy or gold-plated copper alloy, brass, nickel, brass alloy, nickel alloys or any combinations thereof.

21. An apparatus as in claim 17, wherein said XLR connector is a female XLR or a male XLR connector.

22. An apparatus as in claim 17, further comprising at least one securing means to secure said wire in said terminal block.

23. An apparatus as in claim 17, wherein said plate is chosen from the group consisting of a guiding plate or a receiving plate.

24. An apparatus as in claim 17, wherein said at least electrically conducting wires are connected to an audio component selected from the group consisting of processors, auto mixers, reverb units, compressors, limiters, delays, routers, surround sound processors, amplifiers, digital to analog converters, analog to digital converters, speaker processors, connecting panels, microphone boxes, and microphone snakes.

25. An apparatus for transferring an audio signal between at least two audio components, comprising:

a connector block with three wells and a top side and a bottom side;

a terminal block, wherein a bottom portion of said terminal block is in communication with the topside of said connector block;

a securing means to secure at least three electrically conducting wires within said terminal block, wherein said terminal block allows for the receipt of a second set of electrically conducting wires is in contact with said first pin, said second pin and said third pin as to effectuate a daisy chain between a multitude of audio components;

three pins, wherein said bottom side of said connector block allows for the receipt of said three pins, said three pins each has a top end and a bottom end and said top end is in electrical communication with corresponding said electrically conducting wires, said bottom end of said three pins is in electrical communication with an XLR connector; and a mechanical connecting means such as to effectuate a mechanical and electrical connection between said bottom end of three pins and said XLR connector.

* * * * *